United States Patent [19]

Simmons et al.

[11] 4,212,238

[45] Jul. 15, 1980

[54] ROTARY DOG ASSEMBLY

[75] Inventors: James R. Simmons, Homewood; Frank C. Weller, Chicago, both of Ill.

[73] Assignee: Interlake, Inc., Oak Brook, Ill.

[21] Appl. No.: 17,284

[22] Filed: Mar. 5, 1979

[51] Int. Cl.[2] ..... B65B 13/22

[52] U.S. Cl. ..... 100/32

[58] Field of Search ..... 100/2, 29, 30, 32

[56] References Cited

U.S. PATENT DOCUMENTS

| | | | |
|---|---|---|---|
| 3,590,729 | 7/1971 | Plattner | 100/32 |
| 3,687,059 | 8/1972 | Plattner | 100/30 |

*Primary Examiner*—Billy J. Wilhite

*Attorney, Agent, or Firm*—Vogel, Dithmar, Stotland, Stratman & Levy

[57] ABSTRACT

Strap feeding and tensioning apparatus is provided for use in a strapping machine to feed steel or plastic strapping in a loop around an object to be strapped and tension the strap loop about the object, providing maximum gripping force on the strap and minimum marring thereof. The apparatus includes a motor-driven drive wheel geared to a feed wheel, the drive wheel and feed wheel respectively having circumferential strap-engaging surfaces which cooperate frictionally to grip the strapping therebetween and move the strapping in a tensioning direction in response to rotation of the drive wheel. The axis of rotation of the feed wheel is shiftable about a fixed axis to accommodate movement of the feed wheel toward and away from the drive wheel, tensioning of the associated strap exerting a resultant force on the feed wheel tending to effect movement thereof about the fixed axis in a direction to increase the frictional gripping force exerted on the associated strap by the feed wheel and the drive wheel. The axes of the drive and feed wheels lie in a plane disposed at a predetermined angle of less than 26 degrees with respect to a plane defined by the fixed axis and feed wheel axis. For use with steel strap the strap-engaging surfaces of the drive and feed wheels are substantially smooth and the predetermined angle can be as low as about 6 degrees. For use with plastic strapping the drive wheel has a toothed or knurled strap-engaging surface and the predetermined angle can be as low as about 12 degress.

7 Claims, 6 Drawing Figures

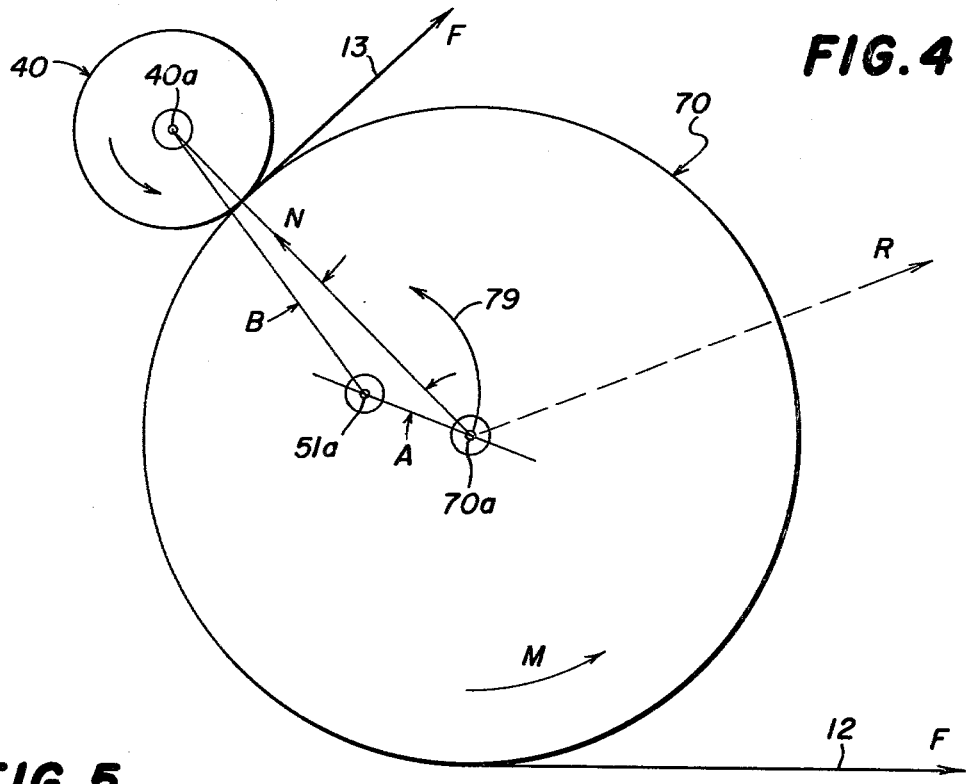
FIG. 4
FIG. 5
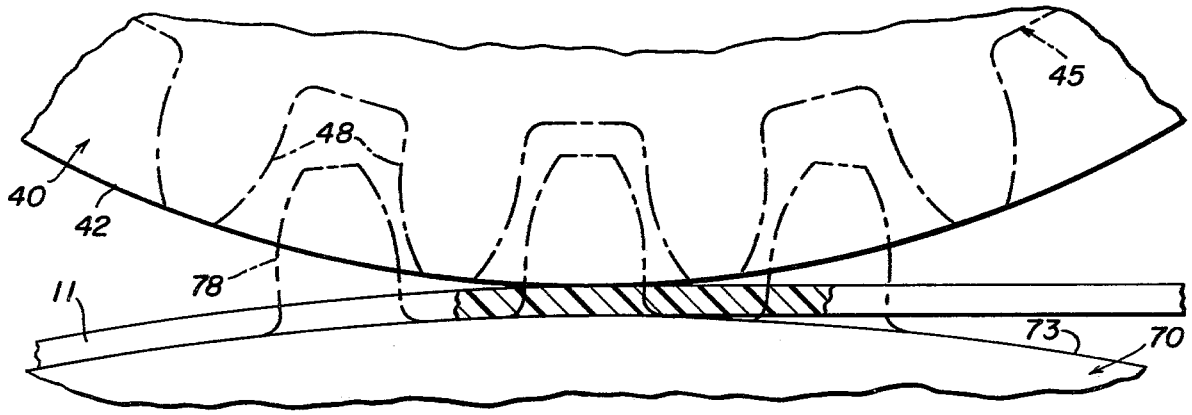
FIG. 6
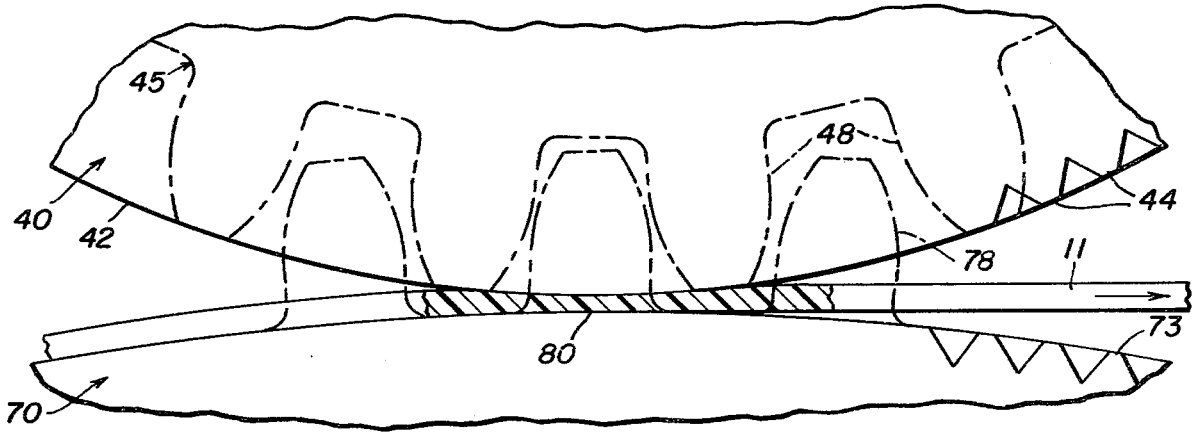

ROTARY DOG ASSEMBLY

BACKGROUND OF THE INVENTION AND PRIOR ART STATEMENT

The present invention relates to an improved strap feeding and tensioning apparatus for use in a strapping machine for applying a strap around an object. More particularly, the present invention relates to a strap feeding and tensioning apparatus which is particularly adapted for use with steel or plastic strapping.

Prior art strapping machines are disclosed, for example, in U.S. Pat. No. 3,146,649, issued to E. Staron et al. on Sept. 1, 1964 and U.S. Pat. No. 3,768,397, issued to Robert F. Plattner on Oct. 30, 1973. These strapping machines, which are designed for use with steel strapping, typically include feeding and tensioning apparatus which includes a motor-driven feed wheel which cooperates with an idler feed wheel frictionally to grip the steel strapping therebetween, for moving the strap in feeding or tensioning directions, depending upon the direction of rotation of the drive wheel. To facilitate this gripping action, the drive wheel is provided with a plurality of gripping teeth or serrations. Another example of such a prior art strapping machine is manufactured by the assignee of the present invention under the designation "G9E Strapping Head", which is disclosed in an Interlake Instruction Manual for that machine, Form 1243R11-77. In this latter machine, the axis of rotation of the idler feed wheel is movable with respect to the axis of rotation of the drive wheel. A copy of this instruction manual, together with copies of the aforementioned prior art patents, are filed with this application, and they represent the most pertinent prior art of which applicant is aware.

But in these prior machines the amount of gripping force exerted on the strap by the drive and feed wheels has been limited to a predetermined range since forces in excess of that range cause the teeth or serrations on the drive wheel to score or penetrate the strapping, which could lead to severing of the strap under tension.

Yet, it is necessary to maintain considerable gripping force on the strapping, otherwise there will be a tendency for the strap to slip between the drive wheel and feed wheel as the tension in the strap is increased.

SUMMARY OF THE INVENTION

The present invention is directed to an improved strap feeding and tensioning apparatus which avoids the disadvantages of prior art devices, while at the same time affording other operational advantages.

It is a general object of this invention to provide apparatus for tensioning a length of strap without unduly marring the surface of the strap or otherwise jeopardizing the integrity of the strap under tension, yet applying a maximum gripping force to the strap for maximizing the tension under which it can be placed.

In connection with the foregoing object, it is another object of this invention to provide strap tensioning apparatus in which the strap is engaged only by substantially smooth surfaces.

Another object of this invention is to provide strap tensioning apparatus which grips the associated strap with a force which increases as the strap tension increases, thereby to prevent slippage of the strap with respect to the tensioning apparatus.

It is another object of this invention to provide strap tensioning apparatus for simultaneously applying frictional driving forces to both sides of the strap.

Yet another object of this invention is to provide strap tensioning apparatus for tensioning either plastic or steel strap.

These and other objects of the invention are attained by providing apparatus for tensioning a length of strap held at one end thereof without marring the surface thereof, the apparatus comprising a drive wheel mounted for rotation about a fixed first axis and having a substantially smooth circumferential drive surface adapted to contact the associated strap in frictional engagement therewith, a feed wheel mounted for rotation about a movable second axis parallel to the first axis and having a substantially smooth circumferential feed surface adapted to contact the associated strap in frictional engagement therewith, the second axis being shiftable about a third axis parallel to the second axis to accommodate movement of the feed wheel toward and away from the drive wheel, the feed wheel being normally disposed in a rest configuration wherein a plane defined by the first and second axes is disposed at an angle less than 26 degrees with respect to a plane defined by the second and third axes and with said feed surface disposed for cooperation with the drive surface frictionally to grip the associated strap therebetween, and drive means coupled to the drive wheel for rotation thereof to cooperate with the feed wheel frictionally to move the associated strap in a tensioning direction, tensioning of the associated strap exerting a resultant force on the feed wheel tending to effect movement thereof about the third axis from the rest configuration in a direction to increase the frictional gripping force exerted on the associated strap by the feed surface and the drive surface, whereby the frictional gripping force exerted on the associated strap is increased as the tension thereof is increased for minimizing slippage of the associated strap without marring the surface thereof.

Further features of the invention pertain to the particular arrangement of the parts of the tensioning apparatus whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 4 is a diagrammatic view, similar to FIG. 1, illustrating the forces applied to the parts and the relative movements undergone thereby;

FIG. 5 is an enlarged fragmentary view in vertical section of the region of engagement of the feed wheel and drive wheel with the associated strap when the feed wheel is disposed in its rest configuration; and FIG. 6 is a view similar to FIG. 4, showing the position of the parts when the strap is under substantial tension, and illustrating the toothed or knurled embodiment of drive and feed wheels.

DESCRIPTION OF THE PREFERRED EMBODIMENT

Figure 2:
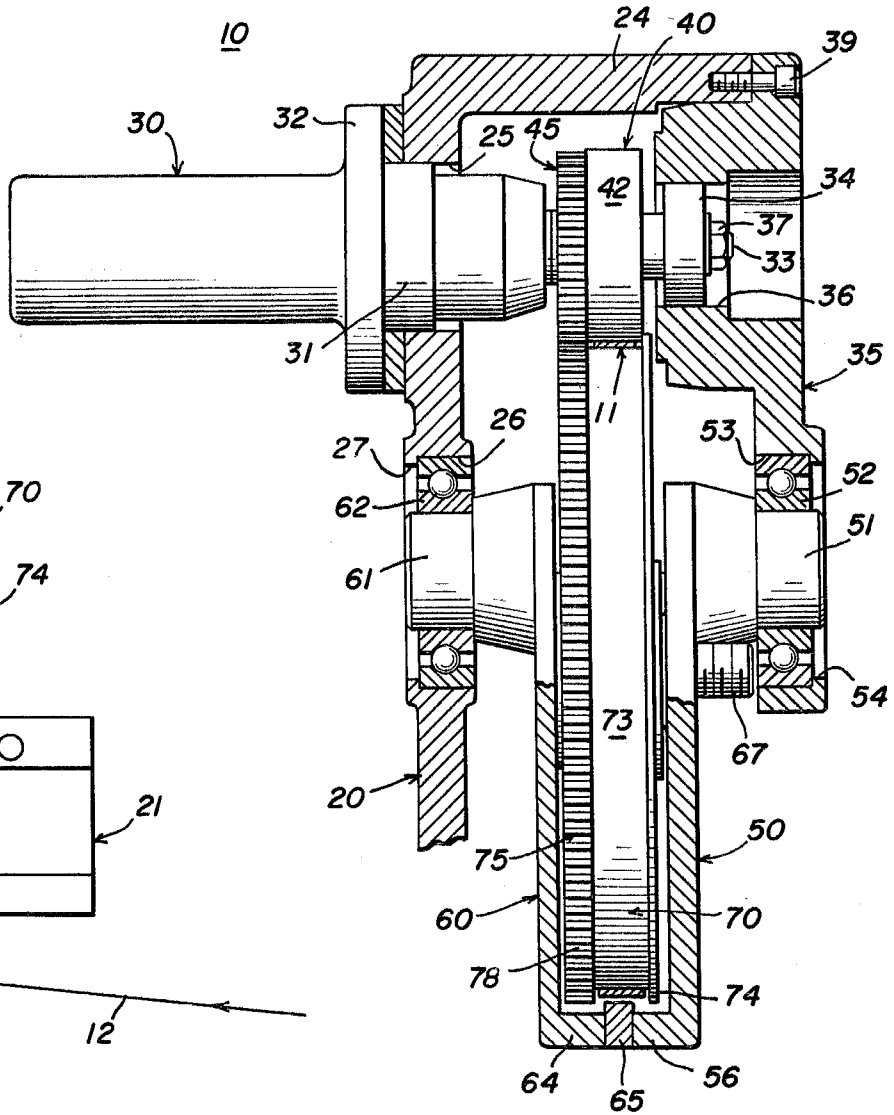
FIG. 2 is a fragmentary view in vertical section taken along the line 2—2 in FIG. 1.
Figure 1:
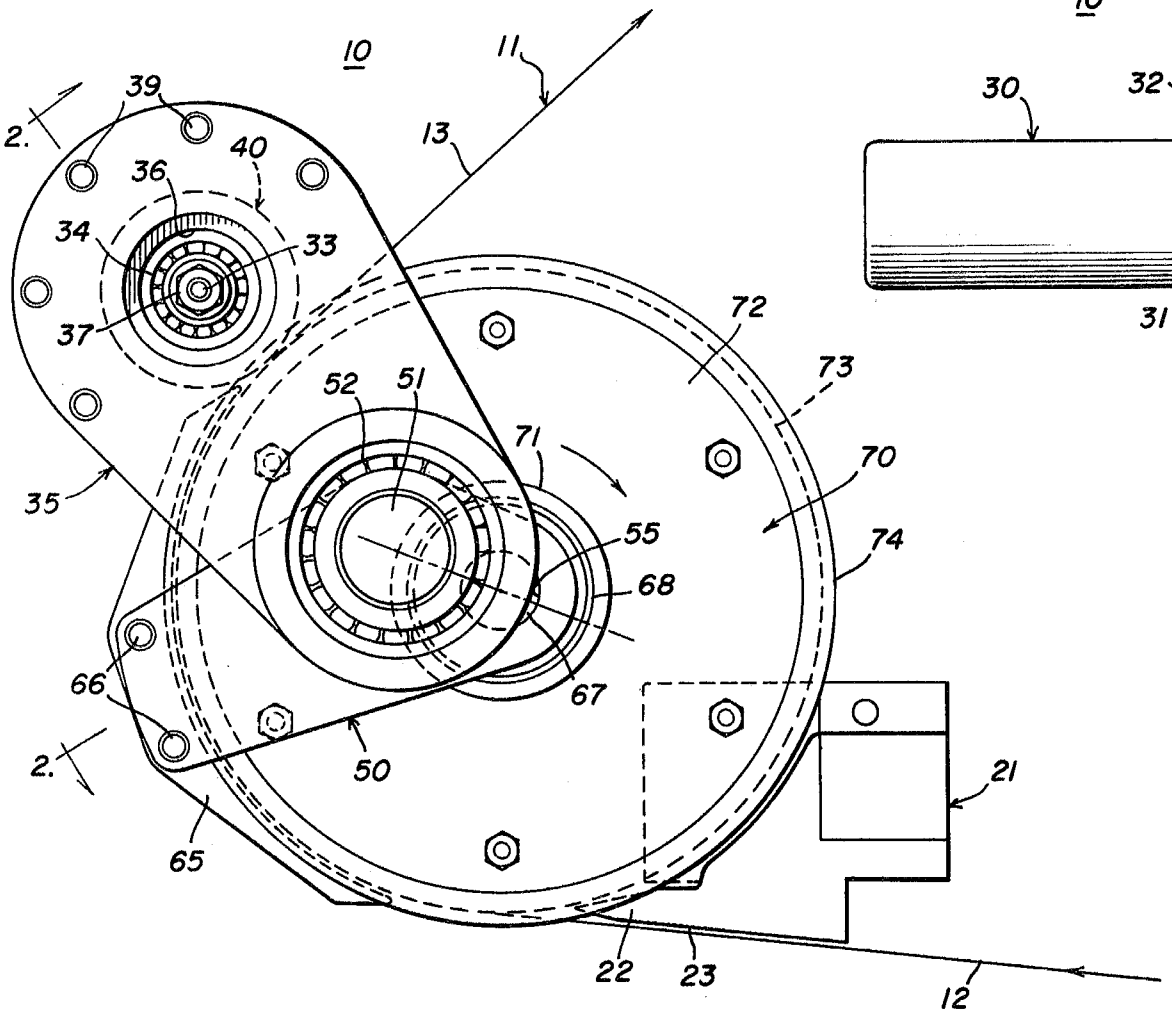
FIG. 1 is a front elevational view of the strap feeding and tensioning apparatus constructed in accordance with and embodying the features of the present invention.
Figure 3:
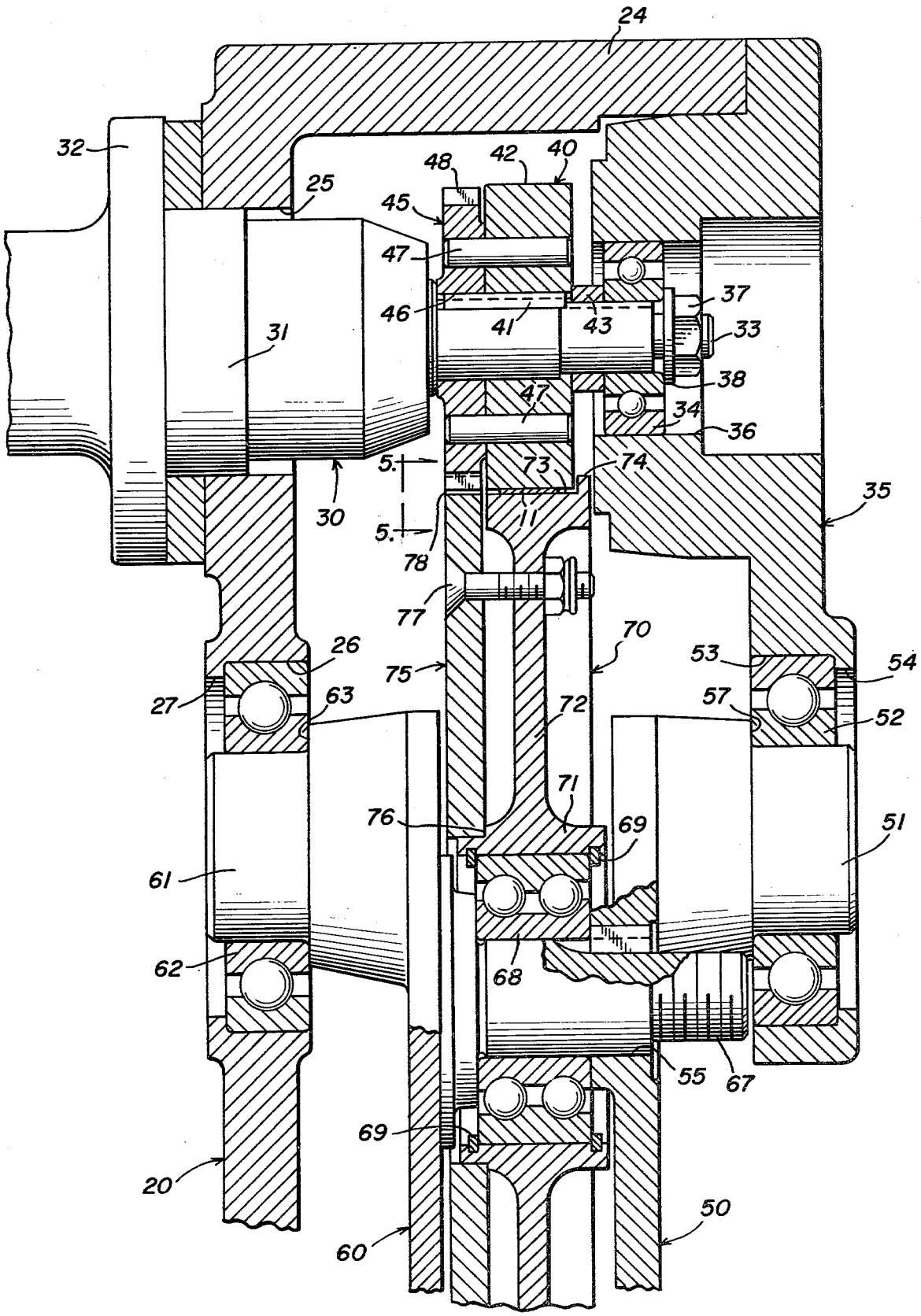
FIG. 3 is an enlarged fragmentary view similar to FIG. 2, and further showing the feed wheel and drive wheel and associated gears in section to illustrate the construction thereof.

Referring to FIGS. 1 through 3 of the drawings, there is illustrated a feeding and tensioning assembly, generally designated by the numeral 10, which is constructed in accordance with and embodies the features of the present invention for the purpose of feeding a length of strap 11 to an associated strapping head and tensioning the strap 11 about an associated object. The strap 11 includes a loop portion 12 which extends between the feeding and tensioning assembly 10 and the associated strapping head (not shown), and a supply portion 13 which extends between the feeding and tensioning assembly 10 and an associated supply coil or the like (not shown), the arrows on the strap 11 in FIG. 1 pointing in the direction of the associated strap supply.

The assembly 10 is similar in construction to the feeding and tensioning portion of the aforementioned Interlake G9E Strapping Head, and includes a frame plate, generally designated by the numeral 20, which is preferably integrally formed of metal such as cast iron, steel or the like. Fixedly secured to the frame plate 20 is a guide block, generally designated by the numeral 21 (FIG. 1), which includes a guide finger 22 having a guide surface 23 thereon. Integral with the frame plate 20 and extending forwardly therefrom is a part-cylindrical casting 24 (FIGS. 2 and 3). Formed in the frame plate 20 coaxially with the part-cylindrical casting 24 is a circular aperture 25 and, spaced a predetermined distance from the aperture 25, is a larger circular aperture 26 having a reduced diameter rear portion defined by an annular shoulder 27.

An air motor, generally designated by the numeral 30, is carried by the frame plate 20, the air motor 30 including a cylindrical shoulder portion 31 which is snugly received in the aperture 25, and a radially outwardly extending annular mounting flange 32 which is disposed along the rear surface of the frame plate 20 and is fixedly secured thereto by suitable fastening means. The air motor 30 is provided with an output shaft 33 which extends coaxially through the part-cylindrical casting 24, the foreward end of the shaft 33 being journaled in a ball bearing 34 which is mounted in a complementary circular opening 36 in a support plate 35 which is fixedly secured to the front end of the part-cylindrical casting 24 by suitable fasteners such as mounting screws 39. Preferably, the forward end of the air motor shaft 33 is externally threaded and receives thereon a locknut 37 which cooperates with a washer 38 fixedly to position the shaft 33 with respect to the bearing 34. It will be appreciated that, if desired, suitable spacing means may be inserted between the air motor mounting flange 32 and the frame plate 20 accurately to position the air motor 30 within the part-cylindrical casting 24.

Fixedly secured to the shaft 33 coaxially therewith is a drive wheel, generally designated by the numeral 40, which is non-rotatably held with respect to the shaft 33 as by a spline or key 41. The drive wheel 40 is provided with an outer circumferential cylindrical drive surface 42 which, in one embodiment of the invention, is substantially smooth, but which may also be toothed, serrated or knurled, as at 44 (see FIG. 6). If desired, the drive wheel 40 may be positioned with respect to the bearing 34 by a suitable spacer washer 43. Fixedly secured to the rear side of the drive wheel 40 coaxially therewith is an external spur gear, generally designated by the numeral 45, which preferably has a keyway 46 for receiving therein the key 41 non-rotatably to hold the gear 45 on the air motor shaft 33. Preferably, the gear 45 is also coupled to the drive wheel 40 by a plurality of coupling pins 47 received in complementary aligned openings through the drive wheel 40 and gear 45. The gear 45 is provided with a circumferential array of gear teeth 48 (see FIGS. 5 and 6).

The assembly 10 also includes an irregularly-shaped front eccentric shaft plate, generally designated by the numeral 50, which is disposed just behind the lower end of the support plate 35. Integral with the front eccentric shaft plate 50 and extending forwardly therefrom is a cylindrical stub shaft 51 which is journaled in a ball bearing 52 mounted in a circular aperture 53 in the support plate 35, the aperture 53 having a reduced diameter front portion defined by an annular shoulder 54. The shoulder 54 cooperates with a shoulder 57 at the rear end of the stub shaft 51 for retaining the bearing 52 in place. Formed through the front eccentric shaft plate 50 a predetermined distance from the stub shaft 51 is a circular opening 55. Integral with the front eccentric shaft plate 50 at one end thereof and extending rearwardly therefrom is an attachment flange 56.

The assembly 10 is also provided with a rear eccentric shaft plate, generally designated by the numeral 60, which is disposed just in front of the frame plate 20. Integral with the rear eccentric shaft plate 60 and projecting rearwardly therefrom is a cylindrical stub shaft 61 which is journaled in a ball bearing 62 disposed in the aperture 26 in the frame plate 20 and against the shoulder 27, which shoulder cooperates with a shoulder 63 at the front end of the stub shaft 61 for holding the bearing 62 in place. Integral with the rear eccentric shaft plate 60 at one end thereof and projecting forwardly therefrom is an attachment flange 64, which is disposed in use in opposing relationship with the attachment flange 56 of the front eccentric shaft plate 50 and cooperates therewith for clamping therebetween an arcuate retainer 65, held in place by suitable fasteners 66.

Also integral with the rear eccentric shaft plate 60 and projecting forwardly therefrom coaxially with the opening 55 in the front eccentric shaft plate 50 is a feed wheel shaft 67 which is journaled in a ball bearing 68, which is in turn held in place by a pair of retaining clips 69 within the hollow cylindrical hub 71 of an associated feed wheel, generally designated by the numeral 70. The feed wheel 70 includes an annular web 72 which is integral with the hub 71 and extends radially outwardly therefrom, and an outer circumferential cylindrical feed surface 73 which is substantially smooth and is spaced from the drive surface 42 of the drive wheel 40 a predetermined distance equal to or slightly less than the thickness of the associated strap 11. Integral with the feed surface 73 at the forward edge thereof and projecting radially outwardly therefrom is an annular retaining flange 74.

Fixedly secured to the rear of the feed wheel 70 coaxially therewith is an external spur gear 75, which has a circular opening therethrough defining a cylindrical surface which is received against a complementary shoulder 76 of the feed wheel 70. Preferably, the gear 75 is secured to the annular web 72 of the feed wheel 70 by a plurality of angularly spaced-apart fasteners, such as screws 77 and complementary nuts. The gear 75 is provided with a circumferential array of teeth 78 (see FIGS. 5 and 6), which teeth are disposed for meshing engagement with the teeth 48 of the gear 45. Preferably, the front end of the feed wheel shaft 67 is externally threaded and cooperates with an associated nut (not shown) securely to hold the shaft 67 in place with respect to the front eccentric shaft plate 50.

Referring now also to FIGS. 4 through 6 of the drawings, the operation of the feeding and tensioning assembly 10 will now be described. Preferably, the strap 11 has a thickness in the range of from about 0.015 inch to about 0.035 inch. The strap 11 is fed from the associated supply between the drive surface 42 of the drive wheel 40 and the feed surface 73 of the feed wheel 70, partway around the circumference of the feed wheel 70 along the feed surface 73, and thence along the guide surface 23 of the guide block 21 and to the associated strapping head. The retainer 65 and attachment flanges 56 and 64 cooperate to retain the strap 11 in place around the feed wheel 70. The feed wheel 70 is resiliently urged by suitable bias means (not shown) to a normal rest configuration, illustrated in FIGS. 1, 4 and 5, wherein the feed surface 73 is spaced from the drive surface 42 by a distance equal to or very slightly less than the thickness of the associated strap 11 so that the drive surface 42 and the feed surface 73 cooperate frictionally to grip the strap 11 therebetween. Thus, when the drive wheel 40 is rotated by the air motor 30 it will cause an opposite-direction rotation of the feed wheel 70, thereby frictionally to move the strap 11 therebetween.

Initially, the air motor 30 is operated to rotate the drive wheel 40 in a clockwise direction, as viewed in FIGS. 1 and 4, thereby including a counterclockwise rotation of the feed wheel 70 for moving the associated strap 11 downwardly around the feed wheel 70 and to the associated strapping head during the strap feeding operation for forming a loop of strap around an associated object. During this feeding operation, there is little, if any, tension in the strap 11. After the loop has been formed around the associated object, the air motor 30 is rotated in the opposite direction for rotating the drive wheel 40 in a counterclockwise direction, as viewed in FIGS. 1 and 4, thereby effecting clockwise rotation of the feed wheel 70 and moving the associated strap 11 upwardly around the feed wheel 70 back toward the strap supply in a tensioning direction for tightening the loop of strap around the associated object.

As the tension increases in the strap 11, the strap exerts forces on the feed wheel 70 in the direction of the arrows F in the strap in FIG. 4, which produces a resultant force on the feed wheel 70 in the direction of the arrow R, which passes through the axis of rotation 70*a* of the feed wheel 70. But the feed wheel shaft 67 is carried by the front and rear eccentric shaft plates 50 and 60 which are rotatable about the axis 51*a* of the stub shafts 51 and 61 thereof, which axis is fixed with respect to the support plate 35. Thus, referring to FIG. 4, the resultant force on the feed wheel 70 creates a moment in the direction of the arrow M which tends to shift the feed wheel 70 with respect to the axis 51*a* toward the drive wheel 40 in the direction of the arrow 79. This shifting movement of the feed wheel 70 tends to urge the feed surface 73 closer to the drive surface 42, thereby serving to increase the normal gripping force exerted on the strap 11 by the feed wheel 70 and drive wheel 40 in the direction of the arrow N, which extends between the axis of rotation 40*a* of the drive wheel 40 and the axis of rotation 70*a* of the feed wheel 70 normal to the drive surface 42 and the feed surface 73. It will be appreciated that the higher the tension in the strap 11, the greater the resultant force R on the feed wheel 70, and the greater the gripping force N on the strap 11. Thus, the gripping force on the strap 11 increases as the tension therein increases, thereby to limit slippage of the strap 11 with respect to the drive surface 42 and feed surface 73, without marring the surface of the strap 11.

In order to accommodate a slight shifting movement of the feed wheel 70 toward the drive wheel 40 as the tension in the strap 11 increases, the gears 45 and 75 are so arranged that the teeth 48 and 78 thereof are initially disposed in a relatively loose meshing engagement when the feed wheel 70 is disposed in its rest configuration, illustrated in FIGS. 1 and 5 of the drawings, the teeth 48 and 78 being so shaped and arranged, however, that effective driving engagement is achieved. This geared movement of the drive wheel 40 with the feed wheel 70 serves to equalize the frictional gripping forces applied to the opposite sides of the strap 11, further to minimize slippage thereof under tension. As the feed wheel 70 shifts toward the drive wheel 40 under the urging of the tensioned strap 11, the teeth 78 and 48 move toward a fully meshed configuration, illustrated in FIG. 6. This movement may result in a slight compression of the strap 11 between the drive wheel 40 and feed wheel 70 as at 80 in the case of plastic strap, but this does not adversely affect the strap. It will be understood that, when the tension in the strap 11 is relieved, the feed wheel 70 returns to its initial rest configuration.

The substantially smooth drive surface 42 and feed surface 73 have been found to work particularly well with steel strapping, since they permit a significant increase in the gripping force which can be applied to the strap 11 without marring the surface thereof. However, in the case of plastic strap, it has been found necessary to utilize a drive wheel having a toothed or knurled drive surface 42 in order to obtain adequate gripping of the strap. More particularly, it has been found that some degree of strap penetration by the drive wheel is necessary in order to properly grip the strap, and the newer plastic materials have sufficient tensile strength that they can withstand some tooth penetration without significant weakening of the strap under tension.

It has been found that for best results, the feed wheel 70 and drive wheel 40 should be so arranged that the axes of rotation 70*a* and 40*a* thereof define a plane (the plane of the normal force arrow N in FIG. 4) which is disposed at an acute angle A with respect to a plane defined by the axis 70*a* and the axis 51*a* of the stub shafts 51 and 61, the angle A being less than 26 degrees. More particularly, it has been found that for steel strap, with smooth drive surface 42 and feed surface 73, the angle A can be as low as approximately 6 to 8 degrees. This is a significant improvement over prior art devices, wherein it was assumed that the optimum value for angle A was 26 degrees.

In general, the smaller the angle A the greater the normal gripping force N exerted on the strap 11 and, therefore, the greater the tension which can be drawn on the strap 11. However, when the angle A gets below approximately 6 to 8 degrees, there is a tendency for the apparatus to jam. In the case of plastic strap, wherein a toothed drive surface 42 is necessary, the angle A can range down to approximately 12 degrees before the strap penetration by the gripping teeth or serrations becomes excessive. It will also be appreciated that the angle B which is defined between the plane of the normal force arrow N and the plane defined by the axis 40*a* of the axis 51*a* is directly proportional to the angle B and, in the preferred embodiment, it is approximately 8 degrees. In practice, the normal force on the strap 11 imparted by the feeding and tensioning assembly 10 may be on the order of several thousand lbs.

Preferably, the dimensions of the feed wheel 40 and drive wheel 70 and of the gears 45 and 75 are such that, as they are rotated, the linear speeds of the drive surface 42 and feed surface 73 at the point of engagement with the strap 11 are substantially equal so as to impart a balanced frictional driving force to both sides of the strap simultaneously, and further to minimize any tendency toward slippage of the strap 11 with respect to the drive wheel 40 or the feed wheel 70.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. Apparatus for tensioning a length of strap held at one end thereof without marring the surface thereof, said apparatus comprising a drive wheel mounted for rotation about a fixed first axis and having a substantially smooth circumferential drive surface adapted to contact the associated strap in frictional engagement therewith, a feed wheel mounted for rotation about a movable second axis parallel to said first axis and having a substantially smooth circumferential feed surface adapted to contact the associated strap in frictional engagement therewith, said second axis being shiftable about a third axis parallel to said second axis to accommodate movement of said feed wheel toward and away from said drive wheel, said feed wheel being normally disposed in a rest configuration wherein a plane defined by said first and second axes is disposed at an angle less than 26 degrees with respect to a plane defined by said second and third axes and with said feed surface disposed for cooperation with said drive surface frictionally to grip the associated strap therebetween, and drive means coupled to said drive wheel for rotation thereof to cooperate with said feed wheel frictionally to move the associated strap in a tensioning direction, tensioning of the associated strap exerting a resultant force on said feed wheel tending to effect movement thereof about said third axis from said rest configuration in a direction to increase the frictional gripping force exerted on the associated strap by said feed surface and said drive surface, whereby the frictional gripping force exerted on the associated strap is increased as the tension thereof is increased for minimizing slippage of the associated strap without marring the surface thereof.

2. The apparatus of claim 1, wherein said acute angle is no less than about 6 degrees.

3. The apparatus of claim 1, wherein said acute angle is in the range of from about 8 degrees to about 25 degrees.

4. The apparatus of claim 1, wherein said third axis is fixed with respect to said first axis.

5. The apparatus of claim 1, wherein said third axis is disposed between said first and second axes.

6. The apparatus of claim 1, wherein said acute angle increases as the tension in the associated strap increases.

7. The apparatus of claim 1, and further including first and second gear means respectively coupled to said drive wheel and said feed wheel and disposed in meshing engagement for simultaneous rotation of said drive wheel and said feed wheel in opposite directions, said first and second gear means being disposed in loose meshing engagement when said feed wheel is disposed in the rest configuration thereof, said first and second gear means moving toward full meshing engagement as said feel wheel moves from said rest configuration toward said drive wheel.

* * * * *